United States Patent [19]

Rausch et al.

[11] 4,372,995

[45] Feb. 8, 1983

[54] PROCESS OF MAKING SURFACE ALLOYED PARTS

[75] Inventors: John J. Rausch, Rte. 2, Box 177, Antioch, Ill. 60002; Ray J. Van Thyne, 1070 Valley Lake Dr., Inverness, Ill. 60067

[73] Assignees: John J. Rausch; Ray J. Van Thyne; Material Sciences Corporation, all of Mt. Prospect, Ill.

[21] Appl. No.: 271,128

[22] Filed: Jun. 8, 1981

[51] Int. Cl.[3] ..... C23C 1/08; C23C 1/10

[52] U.S. Cl. ..... 427/300; 427/431; 427/432

[58] Field of Search ..... 427/300, 253, 156, 116, 427/433, 431, 432; 118/406, 504

[56] References Cited

U.S. PATENT DOCUMENTS

| | | | |
|---|---|---|---|
| 1,312,716 | 8/1919 | Wise | 427/300 |
| 3,097,959 | 7/1963 | Zachman | 427/300 |
| 3,620,816 | 11/1971 | Rausch | 427/433 |
| 3,778,299 | 12/1973 | Rausch et al. | 427/433 X |

*Primary Examiner*—Evan K. Lawrence

*Attorney, Agent, or Firm*—Dithmar, Stotland, Stratman & Levy

[57] ABSTRACT

Predetermined diffusing elements such as chromium and/or aluminum are diffused into the surface of a ferrous-based part while preventing, or at least minimizing, bonding of portions of such part to each other or to a fixture with which the part is processed, by constructing the fixture of a barrier material or placing a barrier layer between the member and the part. The barrier has a composition to substantially preclude diffusion therein of the predetermined element and that is capable of withstanding a molten-lead alloy bath. Then the part is contacted by a molten alloy bath consisting essentially of lead and the diffusing elements. Thereafter, the part is separated from the member. The process finds particular use when the part is coiled sheet steel, in which case adjacent flights of coil are spaced by separator means which is made of a barrier material or carries a barrier layer.

23 Claims, 12 Drawing Figures

FIG.10
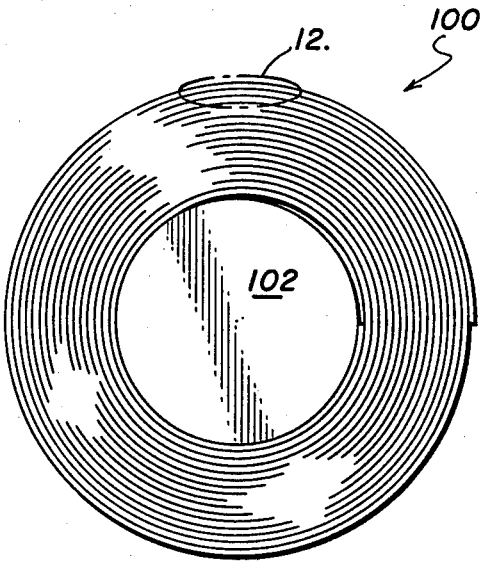
FIG.11
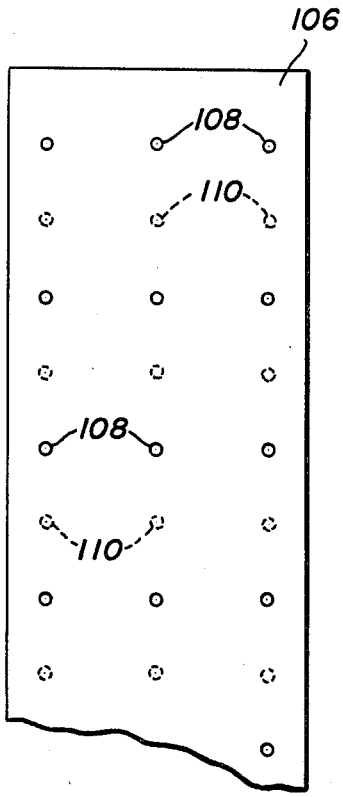
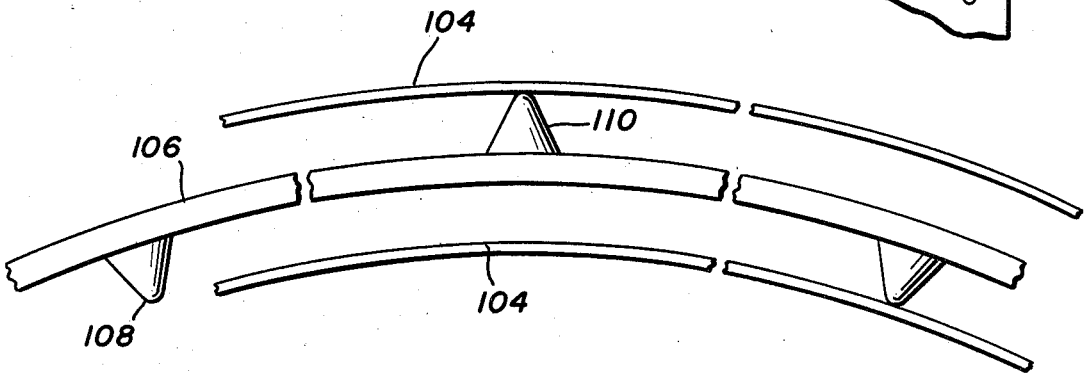
FIG.12

PROCESS OF MAKING SURFACE ALLOYED PARTS

BACKGROUND OF THE INVENTION

U.S. Pat. No. 3,620,816, which issued to the same individuals named as applicants herein, describes a process of diffusion alloying the surface of a ferrous part in a molten lead medium. In that process, elements such as chromium are dissolved into the molten lead, and the lead is placed in contact with the ferrous part to be surfaced. The diffusing element is alloyed into the surface of the part by metallic diffusion at elevated temperatures. The process has been applied simultaneously to multiple small parts where bonding of the parts must be avoided. U.S. Pat. No. 3,778,299, which also issued to the same individuals names as applicants herein, describes a method to avoid bonding in the processing of multiple small parts. In these instances the parts need not be in contact during processing.

However, there are situations where the part which is to be surface alloyed must be in contact with some other member while the processing takes place. For example, the part may be held together by a fixture during processing in which case it is necessary that the fixture not be bonded to the part. Also, surface alloying ferrous-based sheet may be accomplished in a bath of relatively small size by coiling it first. After the processing has been completed, the sheet can be uncoiled. It is important to prevent points on adjacent flights of the coil from becoming bonded to each other.

SUMMARY OF THE INVENTION

It is therefore an important object of the present invention to provide an improved process for surface alloying parts.

Another object is to preclude bonding of parts to fixtures with which they are processed.

Another object is to provide an improved process of making surface alloyed, ferrous-based sheet.

Another object is to provide a process whereby ferrous-based sheet can be surface alloyed in a relatively small sized vat.

In summary, there is provided a process of diffusing at least one predetermined element into the surface of a ferrous-based part while minimizing bonding of the part to a member which is in contact with the part during processing thereof, comprising either constructing the member of a barrier material or placing a barrier layer between the member and the part, wherein the barrier has a composition to substantially preclude diffusion therein of the predetermined element and being capable of withstanding a molten-lead alloy bath, contacting the part with a molten alloy bath consisting essentially of lead and at least the one predetermined element, thereby to create a layer diffused into the part but substantially not into the member, and separating the part from the member.

In a particular use of this process, the part is ferrous-based sheet which is wrapped into a coil. During wrapping, a barrier means is interposed between flights of the sheet to prevent points on the sheet from becoming bonded to other points on the sheet during processing.

The invention consists of certain novel features and a combination of steps hereinafter fully described and particularly pointed out in the appended claims, it being understood that various changes in the details may be made without departing from the spirit, or sacrificing any of the advantages, of the invention.

BRIEF DESCRIPTION OF THE DRAWINGS

For the purposes of facilitating an understanding of the invention, there is illustrated in the accompanying drawings, preferred embodiments thereof, from an inspection of which, when considered in connection with the following description, the invention, its operation, and many of its advantages should be readily understood and appreciated.

FIG. 10 depicts another embodiment of the present invention in which a ferrous-based sheet is wrapped into a coil and a sheet with projections is used to separate adjacent flights;

FIG. 11 is a fragmentary view of one end of the sheet; and

FIG. 12 is an enlarged view of the portion of FIG. 10 within the outline marked "12".

DESCRIPTION OF THE PREFERRED EMBODIMENTS

To alloy the surface of a ferrous-based part, it is placed in a molten lead bath which contains at least one diffusing element such as chromium. The chromium may be in elemental form or in various alloy forms such as ferrochromium. Aluminum may be employed in certain instances as a diffusing element or an additional diffusing element. The temperature of the bath is between 1,600° F. and 2,500° F. and the parts are in the bath for a time from on the order of minutes to twenty-four hours. Chromium is thus diffused into the surfaces of the part to provide a chromized surface or it is diffused throughout. In carrying out such process, it is sometimes necessary to utilize a fixture or other such member with the part. For example, it may be necessary to use a clamp to hold together two components of the part. In such event, it is important that while the diffusing element is diffused into the surfaces of the part, diffusion on the surfaces of the fixture should not take place in such a way that the part becomes bonded to the fixture. At least, diffusion into the fixture surfaces should be minimized so that the part can be readily separated with a minimum defacement of the surfaces of the part. In the present invention, such bonding is avoided, or at least minimized, by placing a barrier layer between the part to be surface alloyed and the fixture or other member or by constructing the fixture or other member of a barrier material.

Figure 1:
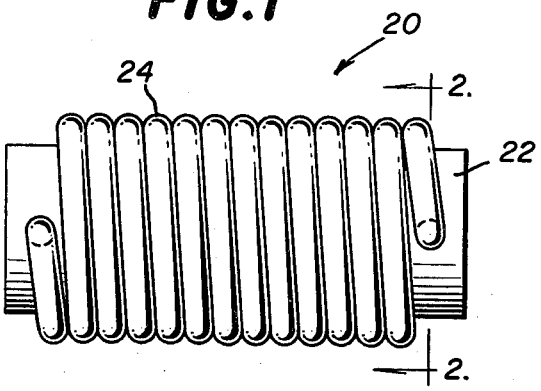
FIG. 1 depicts a bar about which is wrapped a wire, on which experiments were conducted to compare characteristics when a barrier layer is and is not used.
Figure 2:
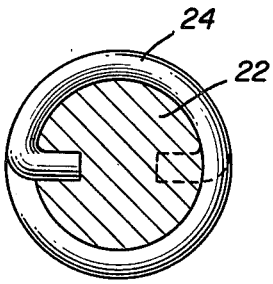
FIG. 2 is a view in transverse cross section taken along the line 2—2 of FIG. 1.

To evaluate the characteristics of various barrier layers, the part 20 shown in FIGS. 1 and 2 was produced. The part 20 includes a cylindrical bar 22 wrapped with wire 24. The ends of the wire 24 were inserted in holes near the ends of the bar 22. Several experiments were conducted with the part 20 in which the composition of the bar 22 and processing thereof were kept the same. In each experiment, the bar 22 had a diameter of 0.375 inch and a length of 1 inch. The wire 24 in each case had a diameter of 0.062 inch and was composed of low carbon steel (0.01% by weight carbon).

Figure 3:
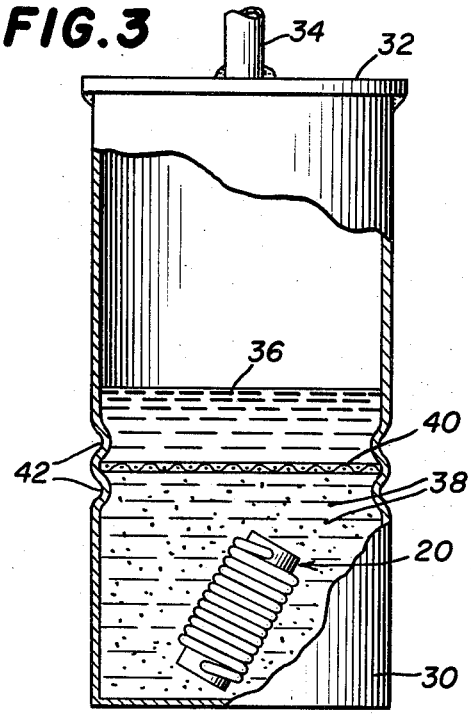
FIG. 3 schematically depicts a sealed tube containing the part of FIG. 1, to demonstrate the way it was processed.

In each experiment, the part 20 was treated in the equipment depicted in FIG. 3, which includes a tube 30 having welded thereto a cover 32 carrying an upstanding tube 34. The tube 30 had a diameter of 2 inches and contained a molten alloy bath in which the transfer agent is lead 36. In the experiments, 2,000 grams of lead were in the tube 30. The bath also contained a diffusing element 38 and the part 20. In these experiments, the tube contained 20 grams of vacuum grade elemental chromium (99.4% by weight chromium). A perforated disc 40 held in place by retaining rings 42 prevents the part 20 from floating. The perforations are small enough to prevent passage of the chromium 38. In assembling the equipment, the part 20 and the chromium 38 are dropped into the tube 30. Then, the tube 30 is deformed to create a lower one of the rings 42, the disc 40 is dropped into place, then the upper one of the rings 42 is created by deforming the wall of the tube 30. A slug of solid lead is placed on the disc 40, and the cover 32 is welded into place. A separate tube (not shown) is used to evacuate the space not occupied by lead.

The covered tube 30 is inserted into a furnace (not shown) to cause the slug to melt and provide molten lead 36. In these experiments, the treatment took place at a temperature of 2,000° F. for 4 hours. Chromium is caused to diffuse into the surfaces of the part 20 by way of the lead as a transfer agent. The details of this processing are described in greater detail in U.S. Pat. No. 3,620,816 mentioned above. It is to be understood that the equipment shown in FIG. 3 is schematic and any number of different kinds and shapes of containers may be employed.

After processing, the part 20 was removed from the bath and cut transversely into two pieces of equal length. One piece was immersed in a solution of boiling nitric acid to remove residual adherent lead. The other piece was mounted in BAKELITE, ground and polished so that the nature of any bonding between the wire 24 and the bar 22 could be determined by metallographic examination.

The extent of bonding of the piece that had been acid cleaned was determined by holding the bar 22 in a vise and grasping the cut end of the wire 24 with a pair of pliers, and then pulling to separate the wire 24 loose from the bar 22. The amount of effort was noted in each experiment.

In the first experiment, the bar 22 was composed of the same material as the wire 24, namely low carbon steel. It was found that considerable force was required to separate the wire 24 from the bar 22, indicating that a significant degree of diffusion bonding occurred between the two. Metallographic examination on the mounted piece indicated that considerable diffusion bonding had occurred, the width of the bond being approximately 8 mils.

Four experiments were conducted in which the composition of the bar 22 and the treatment thereof were such as to create a barrier layer between the bar 22 and the wire 24. In each, the composition of the wire 24 and the processing parameters were as described above. In the first of these four experiments, the bar 22 was constructed of type 304 stainless steel that had been preoxidized at 1,600° F. for one hour in air, creating an oxide barrier layer. After the part 20 was cut into two pieces and processed, it was found that virtually no force was required to separate the wire 24 from the bar 22 of the acid-cleaned piece, and the mounted piece exhibited no detectable diffusion bond between the wire 24 and the bar 22.

In the next experiment, the bar 22 was made of type 446 stainless steel that had been preoxidized at 1,600° F. for one hour in air. Virtually the same results were achieved as with the treated 304 stainless bar.

In the next experiment, the bar 22 was made of low carbon iron having a 2 mil. electrodeposit of chromium plate that was subsequently nitrided in molecular nitrogen at 2,000° F. for four hours. Virtually the same results were obtained as with the stainless steel bars.

In the next experiment, the bar 22 was made of 446 stainless steel, having a 2 mil. electrodeposit of chromium plate that was subsequently boronized at 2,000° F. for four hours. The acid-cleaned piece required some force to separate the wire 24 from the bar 22, but not nearly so much as that required in the initial experiment in which no barrier layer was employed. Metallographic examination of the mounted piece showed evidence of discontinuous bonding over a 1 mil. width.

There are other barrier layers which may be utilized to diminish or preclude diffusion bonding between a member such as a fixture and a part which is to be processed. A ferrous-based fixture can be employed if it has, for example, sufficient carbon, in which case an iron-chromium carbide barrier layer can be created. Also, the member can contain other elements which would form thermally stable carbides as barrier layers. Members containing chromium or titanium can provide barrier layers which are oxides, nitrides or borides. Members containing aluminum or silicon can provide barrier layers which are oxides or nitrides.

Refractory metals including tungsten, molybdenum, tantalum and columbium and their alloys are effective barrier layers. The rate of diffusion interacts between such metals and iron is very low. Since they have relatively low solubility in lead, they can be effectively used as structural components and fixtures, in which case a separate barrier layer is unnecessary.

An important object of this invention is to enable surface alloying ferrous-based sheet in a relatively small space. To accomplish this, it has been proposed to wrap the sheet into a coil, then surface alloy the sheet. When so processed, it is important that there be spaces or channels between adjacent flights of the coil to accommodate flow of the processing bath. An experiment was conducted in which no barrier layer was interposed between the separating medium and the sheet.

Figure 4:
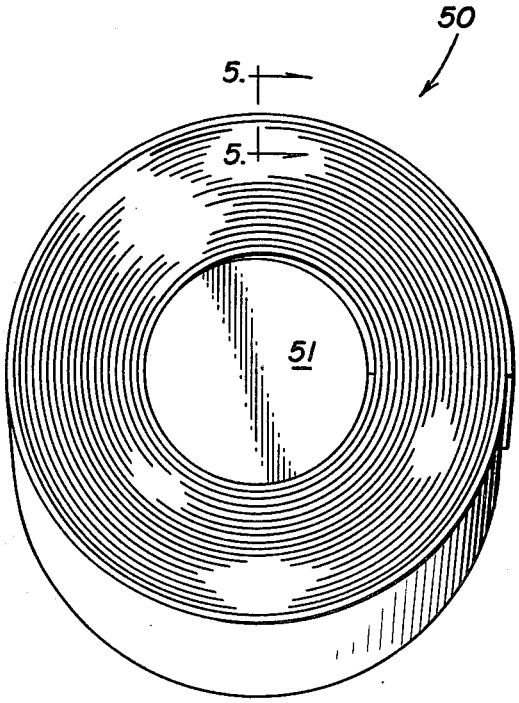
FIG. 4 depicts a second embodiment of the present invention in which sheet is formed into a coil with wire used to separate adjacent flights.
Figure 5:
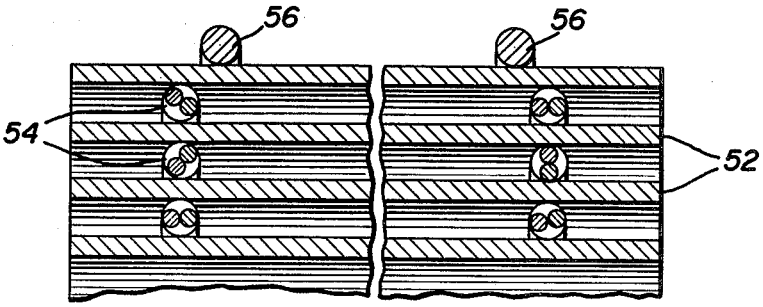
FIG. 5 is a view on an enlarged scale, in transverse cross section, along the line 5—5 of FIG. 4.

Turning now to FIGS. 4 and 5, details of this experiment will be described. The part 50 depicted therein is generally cylindrical and has a cylindrical open core 51. A sheet 52 of ferrous-based material is wound or wrapped around a hub (not shown) so as to create a coil or helix. A pair of laterally spaced-apart, continuous separator wires 54 space adjacent flights of the sheet 52 in the manner shown. In this experiment, the wire 54 had two twisted strands. A pair of wires 36 is wrapped around the outside flight of the coiled sheet 52. In making the part 50, there is provided a supply of sheet 52 and two supplies of wire 54. The ends of the two supplies of wire 54 are placed on a cylindrical hub (not shown) near the sides thereof. The end of the sheet 52 is placed on top of the ends of the wires 54. The sheet 52 and the two wires 54 are then wrapped simultaneously about the hub until a cylinder of desired diameter is generated. The sheet 52 and the wires 54 are then severed, and two lengths of wire 56 are wrapped around the outermost flight. The hub is then removed.

In a particular example, the part 50 was made using sheet 52 composed of low carbon steel containing approximately 0.1% by weight carbon, being 4 inches wide and 0.035 inch thick, which was wrapped into a coil having 20 turns. Each strand of the wire 54 was 0.030 inch in diameter and contained approximately 0.1% weight by carbon. The core 51 had a diameter of 3 inches.

Figure 6:
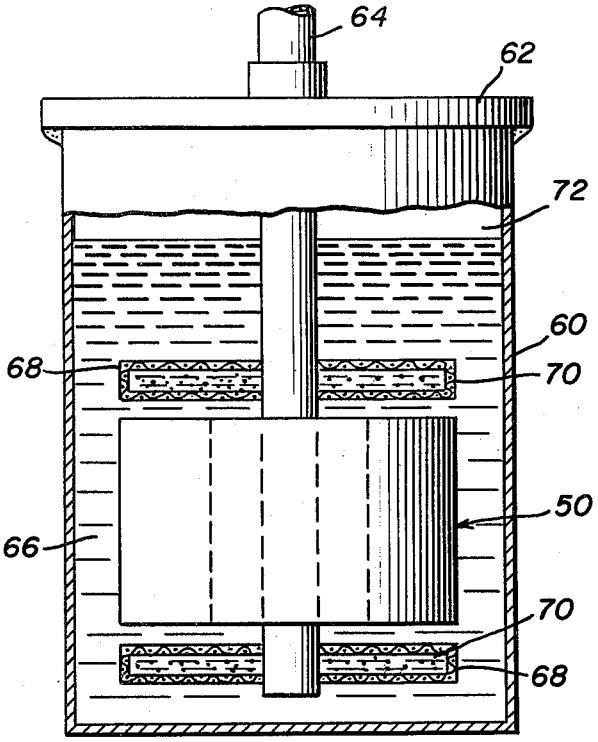
FIG. 6 schematically depicts a sealed tube containing the coil of FIGS. 4 and 5 to demonstrate the way it was made.

The part 50 was processed in the equipment depicted in FIG. 6. A retort 60 has welded thereto a cover 62 through which reciprocally passes an upstanding tube 64. The retort 60 contains an alloy bath in which the transfer agent is lead 66. Two screened cages 68, containing a diffusing element 70, are attached to the drive tube 64 above and below the part 50. The region 72 in the retort 60 not occupied by lead is evacuated through a tube (not shown), and preferably filled with an inert gas. The retort 60 is placed into a furnace. While being heated, the tube 64 is oscillated, to move the part 50 up and down.

In an actual experiment, the tube 64 had a diameter of 1 inch and loosely passed through the 3-inch core 51 of the part 50. The continuous helical channel or spaces between adjacent flights of the sheet is disposed vertically so that lead can flow therethrough. The fact that each of the separator wires 54 has two strands creates space so that the bath can flow through the spaces and contact the surfaces of the sheet 52 in order to diffuse the chromium thereinto. Each cage 68 had 135 grams of vacuum grade chromium of 99.4 percent purity. The retort 60 had an 8-inch diameter and contained 200 pounds of lead 66. The region 72 was evacuated and backfilled with an argon atmosphere and heated to approximately 900° F. Then, the part 50 and the cages 68 were plunged into the lead 66. The heating was continued. At 1,500° F., a 35-gram charge of commercially pure aluminum was added to the bath. The heating was continued until a temperature of 1,700° F. was reached. The tube 64 was reciprocated every few seconds using a 3-inch vertical stroke. The part 50 was processed in this manner for 20 hours after which time the retort 60 was cooled and the part 50 removed.

Metallographic examination showed that a uniform diffusion alloy layer of about 2.5 mils. thick was formed in the areas of the sheet 52 that were not in the immediate vicinity of the spacer wires 54. Microprobe analysis showed the following composition profiles in the diffusion layer:

| Distance from Surface (Microns) | Percent Chromium by Weight | Percent Aluminum by Weight |
|---|---|---|
| 5 | 30.88 | 2.47 |

-continued

| Distance from Surface (Microns) | Percent Chromium by Weight | Percent Aluminum by Weight |
|---|---|---|
| 8 | 28.75 | 2.92 |
| 12 | 26.42 | 2.93 |
| 20 | 19.08 | 2.95 |
| 40 | 10.19 | 2.95 |
| 60 | 5.02 | 2.78 |
| 80 | 2.94 | 2.70 |
| 100 | 0.96 | 2.14 |
| 120 | 0.29 | 1.44 |
| 160 | 0.01 | 0.87 |

In the foregoing example, no barrier layer was applied to the wires 54, whereby diffusion bonding between the wires and adjacent portions of the sheet 52 is liable to occur. To overcome this, a preoxidized stainless wire may be utilized, in which the oxide defines a barrier layer. If the contact area between the preoxidized wire and coil is small enough, diffusion alloying into the adjacent portions of the sheet under the contact area will occur via lateral diffusion. The contact area can be minimized by using a small diameter, knurled or otherwise surface-roughened wire.

Figure 7:
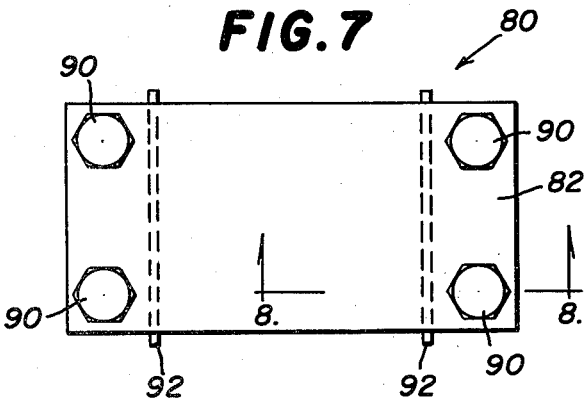
FIG. 7 depicts a series of plates separated by wires, on which experiments were conducted to compare characteristics when a barrier layer is and is not used.
Figure 8:
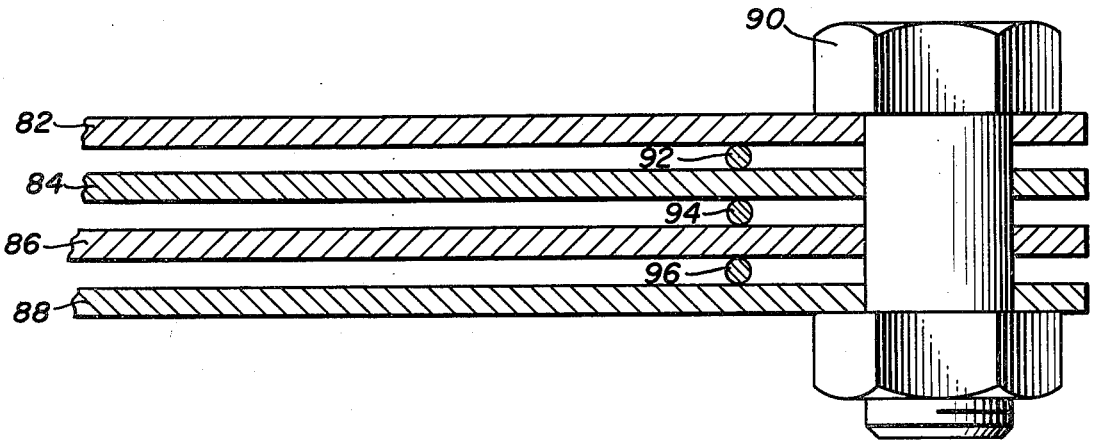
FIG. 8 is a fragmentary view in cross section, on an enlarged scale, taken along the line 8—8 of FIG. 7.

Referring to FIGS. 7 and 8, an experiment will be described which was conducted to determine the effect of barrier layers on the spacer wires. Depicted on FIGS. 7 and 8 is a part 80 comprising four panels 82, 84, 86 and 88, each with four holes in the four corners thereof. Each panel measured 1.5 inch×3 inches×0.044 inch and was constructed of low-carbon steel. Bolts 90 passed through aligned holes. Two parallel, spaced-apart wires 92 were interposed between the panels 82 and 84. The wires 92 were constructed of low carbon steel (0.13% by weight carbon). Disposed between the panels 84 and 86 respectively beneath the wires 92, were wires 94 (one is shown) made of type 304 stainless steel oxidized at 1,700° F. for one hour. Between the panels 86 and 88, respectively in line with the wires 94, were wires 96 constructed of type 304 stainless steel. Each of the wires 92, 94, and 96 had a diameter of 0.047 inch. After the wires 92, 94, and 96 were in place, the bolts 90 were tightened.

Figure 9:
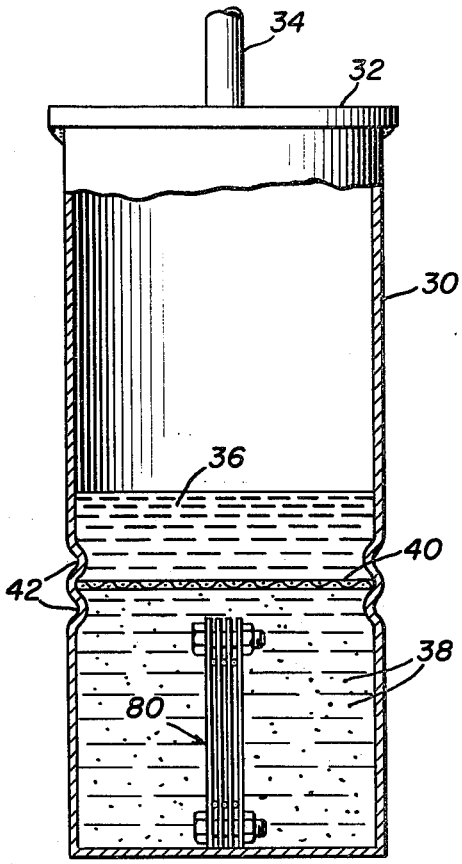
FIG. 9 schematically depicts a sealed tube containing the part of FIGS. 7 and 8.

The part 80 was processed in the equipment depicted in FIG. 9 which has generally the same configuration as the equipment of FIG. 3 so that the same reference numerals are employed. The tube 30 had a 2-inch diameter and contained 25 grams of vacuum grade elemental chromium 38 which was 99.4% pure, and approximately 2,000 grams of lead 36. The part 80 rested on the bottom of the tube 30 and the disc 40 was located 3.5 inches from the bottom. The covered tube 30 was sealed under vacuum, heated to 2,000° F., held at that temperature for four hours and then air cooled to room temperature. The part 80 was removed and sectioned so that various contact areas could be examined metallographically. No chromizing took place in a zone of the panel 82 10 mils. wide and centered at the line of contact with the wire 92. No chromizing took place over a 12 mil. wide zone of the panel 84 centered at the line of contact with the wire 92. Also, the chromizing layer on either side of these two zones was shallower than other areas of the panels 82 and 84. There were zones on the surfaces of the panels 86 and 88 in contact with the wire 96 that had essentially no chromizing. These zones were respectively 7 and 9 mils. wide. However, the surfaces of the panels 84 and 86 facing the oxidized stainless steel wire 94 had essentially a uniform diffusion layer, even in the regions of contact between the wire 94 and the surfaces. There was a zone of the surface of the panel 86 in contact with the wire 94, about 2 mils. in width in which the depth of the chromizing was about 1 mil. In the remainder of that surface, the chromizing layer was 3 mils. deep.

Another embodiment to enable production of surface alloyed sheet is depicted in FIGS. 10–12. The part 100 is generally cylindrical and includes an open cylindrical core 102, a sheet 104 which is to be surface alloyed and a separator sheet 106 having projections 108 that protrude from one surface of the sheet 106, and projections 110 that protrude from the other surface. The sheets 104 and 106 are wound so as to create a pair of interposed coils or helixes. The projections 108 and 110 are arranged in three columns, two near the sides of the sheet 106 and one down the center. In this particular form each row of three projections is on one surface of the sheet 106, while the next row is on the reverse side. The sheets 104 and 106 are wound around a hub (not shown) until a desired diameter part 100 is attained. They may be retained in such position by, for example, the wires 56 in the embodiment of FIGS. 4 and 5. There are other ways of retaining the elements in position. The part 100 is then processed in equipment like that depicted in FIG. 6. In a particular example, the sheet 104 to be processed was 6 mils. thick, 4 inches wide and was constructed of low carbon steel. The separator sheet 106 was also 4 inches wide and was composed of 409 stainless steel which was preoxidized, the oxide defining a barrier layer. The sheet 106 was 0.022 inch thick and the projections 108 and 110 were substantially spherical having a height of 0.050 inch. The projections 108 in each column were 2 inches apart, as were the projections 110. The outside columns of projections 108 and 110 were about one-half inch from the side edges of the sheet 106. The hub had a 5-inch diameter so that the core 102 was 5 inches. The part 100 was then processed in the equipment of FIG. 6, at a temperature of 2,000° F. for 3 hours, which contained both chromium and aluminum as diffusing elements.

To analyze the chromium and aluminum content in the part 100, the sheet 104 was partly unwound. A piece was cut out of each side and out of the center. It was found that one side had a content of 14.8% chromium by weight and 7.31% aluminum by weight. The center piece had a chromium content of 15.30% and an aluminum content of 7.45%, while the other side had a chromium content of 15.00% and an aluminum content of 7.40%. The concentrations were surprisingly uniform.

The zones of the sheet 104 that were in contact with the tips of the projections 108 and 110 were metallographically examined. It was found that the chromium and the aluminum diffused through the entire 6 mil. thickness.

In addition to wires and separator sheets with projections, other separator means could be used, such as strips and tabs. In addition to an oxide barrier, nitrides, carbides and borides will work well also. Such layers can be applied by spraying, painting, sputtering, physical or chemical vapor plating, and electrophoretic deposition, for example. The barrier materials themselves can be used in bulk or granular form as separators between the otherwise adjacent surfaces that are being diffusion alloyed.

What has been described therefore is an improved process for diffusing an element into the surface of ferrous-based parts which are in contact with a fixturing member, which includes placing a barrier layer between the part and the member.

We claim:

1. A process of diffusing at least one predetermined element into the surface of a ferrous-based part while minimizing bonding of the part to a member which is in contact with the part during the process, comprising constructing the member of a barrier material having a composition to substantially preclude diffusion therein of the predetermined element and being capable of withstanding a molten-lead alloy bath, contacting the part with a molten alloy bath consisting essentially of lead and at least the one predetermined element, thereby to diffuse the predetermined element into the part but substantially not into the member, and separating the part from the member.

2. The process of claim 1, wherein the barrier material is a refractory material selected from the group consisting of tungsten, molybdenum, tantalum, columbium and the alloys of tungsten, molybdenum, tantalum and columbium.

3. A process of diffusing at least one predetermined element into the surface of a ferrous-based part while minimizing bonding of the part to a member which is in contact with the part during the process, comprising placing a barrier layer between the member and the part, the barrier layer having a composition to substantially preclude diffusion therein of the predetermined element and being capable of withstanding a molten-lead alloy bath, contacting the part with a molten alloy bath consisting essentially of lead and at least one predetermined element, thereby to diffuse the predetermined element into the part but substantially not into the member, and separating the part from the member.

4. The process of claim 3, wherein the barrier layer is chemically formed on the member.

5. The process of claim 3, wherein the member is a separator sheet carrying spacer means, and the barrier layer is on the spacer means.

6. The process of claim 3, wherein the member is a sheet carrying projections, and the barrier layer is at least on the projections.

7. The process of claim 3, wherein the member is a wire means, and the barrier layer is formed thereon.

8. The process of claim 3, wherein the barrier layer is selected from the group consisting of oxides, nitrides, carbides and borides.

9. The proces of claim 3, wherein the member is composed of stainless steel and the barrier layer is a diffused layer thereon, which layer is selected from the group consisting of oxides, nitrides, carbides and borides.

10. A process of manufacturing ferrous-based sheet having a predetermined element diffused into the surfaces thereof, comprising providing a separator means composed of a barrier material having a composition to substantially preclude diffusion therein of the predetermined element and being capable of withstanding a molten-lead alloy bath, wrapping the sheet into a coil and simultaneously interposing the separator means between flights of the sheet to prevent points on the sheet from contacting other points on the sheet, and contacting the coiled sheet with a molten alloy bath consisting essentially of lead and at least the one predetermined element, thereby to diffuse the predetermined element into the surfaces of the sheet but not into the separator means, and separating the sheet from the member.

11. The process of claim 10, wherein the barrier material is a refractory material selected from the group consisting of tungsten, molybdenum, tantalum, columbium and the alloys of tungsten, molybdenum, tantalum and columbium.

12. A process of manufacturing ferrous-based sheet having a predetermined element diffused into the surfaces thereof, comprising providing a separator means, producing a barrier layer on the separator means, the barrier layer having a composition to substantially preclude diffusion therein of the predetermined element, and being capable of withstanding a molten-lead alloy bath wrapping the sheet into a coil and simultaneously interposing the separator means between flights of sheet to prevent points on the sheet from contacting other points on the sheet, and contacting the coiled sheet with a molten alloy bath consisting essentially of lead and at least the one predetermined element, thereby to diffuse the predetermined element into the surfaces of the sheet but not into the separator means, and separating the sheet from the member.

13. The process of claim 12, wherein the sheet and the separator means are simultaneously wrapped.

14. The process of claim 12, wherein the separator means are wires.

15. The process of claim 12, wherein each of said wires includes more than one strand.

16. The process of claim 12, wherein the separator means is a sheet with projections.

17. The process of claim 12, wherein the separator means is made of stainless steel, and the barrier means is a layer diffused therein, selected from the group consisting of oxides, nitrides, carbides and borides.

18. The process of claim 12, wherein the bath contains two diffusing elements in order to diffuse two elements into the ferrous-based sheet.

19. The process of claim 12, wherein the two diffusing elements are aluminum and chromium.

20. The process of claim 12, wherein the separator means is composed of a refractory material selected from the group consisting of tungsten, molybdenum, tantalum, columbium and the alloys of tungsten, molybdenum, tantalum and columbium.

21. The process of claim 12, wherein the coiled sheet is reciprocated while in the bath.

22. The process of claim 12, wherein said separator means includes projections, and the barrier layer is on the projections.

23. The process of claim 12, wherein the sheet is wrapped around a hub.

* * * * *